US007116927B2

(12) United States Patent
Choi

(10) Patent No.: US 7,116,927 B2
(45) Date of Patent: Oct. 3, 2006

(54) PHOTOSENSITIVE DRUM OF IMAGE FORMING APPARATUS AND METHOD OF DAMPING VIBRATION IN THE DRUM

(75) Inventor: Jeong-Jai Choi, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 11/004,972

(22) Filed: Dec. 7, 2004

(65) Prior Publication Data

US 2005/0226652 A1 Oct. 13, 2005

(30) Foreign Application Priority Data

Apr. 7, 2004 (KR) ..... 10-2004-0023895

(51) Int. Cl.
*G03G 15/00* (2006.01)
*G03G 21/18* (2006.01)

(52) U.S. Cl. ..... 399/159; 399/116; 399/117; 399/91

(58) Field of Classification Search ..... 399/159, 399/115, 116, 117, 91
See application file for complete search history.

(56) References Cited

U.S. PATENT DOCUMENTS 6,075,955 A * 6/2000 Cais et al. ..... 399/91
6,131,003 A * 10/2000 Cais et al. ..... 399/91
6,175,705 B1 * 1/2001 Harada et al. ..... 399/117
6,782,224 B1 * 8/2004 Kim ..... 399/159
2002/0186985 A1 * 12/2002 Fujishiro ..... 399/91

FOREIGN PATENT DOCUMENTS

| | | |
|---|---|---|
| JP | 05-035166 | 2/1993 |
| JP | 05-188839 | 7/1993 |
| JP | 08-335007 | 12/1996 |
| JP | 10-104999 | 4/1998 |
| JP | 11-305598 | 11/1999 |
| JP | 2001-235971 | 8/2001 |
| JP | 2002-207396 | 7/2002 |
| JP | 2002207396 A * | 7/2002 |
| KR | 1999-23330 | 3/1999 |

* cited by examiner

*Primary Examiner*—David M. Gray
*Assistant Examiner*—Joseph S. Wong
(74) *Attorney, Agent, or Firm*—Roylance, Abrams, Berdo & Goodman, LLP

(57) ABSTRACT

A photosensitive drum of an image forming apparatus includes a drum main body having a hollow shape, and a vibration damping body spaced from an inner wall of the drum main body, having a hollow shape, formed with a plurality of slits, and expanding and closely contacting the inner wall of the drum main body while the drum main body rotates.

20 Claims, 7 Drawing Sheets

PHOTOSENSITIVE DRUM OF IMAGE FORMING APPARATUS AND METHOD OF DAMPING VIBRATION IN THE DRUM

CROSS-REFERENCE TO RELATED APPLICATION

This application claims the benefit under 35 U.S.C. §119 (a) of Korea Patent Application No. 2004-23895 filed on Apr. 7, 2004, the entire disclosure of which is incorporated herein by reference.

BACKGROUND OF THE INVENTION

1. Field of the Invention

The present invention generally relates to a photosensitive drum of an image forming apparatus and method of damping vibration in the drum. More particularly, the present invention relates to a photosensitive drum of an image forming apparatus with a structurally improved vibration damper for damping vibration of the photosensitive drum and a method thereof.

2. Description of the Related Art

Generally, an electrophotographic image forming apparatus is used in a printer, a copier, a facsimile, each of which is provided with a photosensitive drum.

The photosensitive drum is composed of a cylindrical drum which is made of a conductive material and has an outer surface onto which a photoconductive material is coated. When a light source emits light with image information toward the photosensitive drum, the physical properties of the applied photoconductive material are changed. Thereby, an electrostatic latent image is formed on the photosensitive drum.

The photosensitive drum resonates due to vibration from the gears of the motor rotating the photosensitive drum. The photosensitive drum is also vibrated due to friction when it contacts a cleaning blade which removes developer remaining on the photosensitive drum so a new electrostatic latent image can be formed.

The vibration of the photosensitive drum causes its rotation speed to fluctuate, so that the photosensitive drum cannot correctly receive the image information from the light source, thereby deteriorating the image quality.

Further, the vibration of the photosensitive drum is transferred to its neighboring units and casing, thereby causing unwanted noise.

To overcome the above problems caused by the vibration of the photosensitive drum, the prior art has proposed installing a vibration damper in the photosensitive drum to dampen the vibrations from the photosensitive drum. Such an example has been disclosed in Japanese Patent Publication No. 2001-235971 (entitled "PHOTOSENSITIVE DRUM AND METHOD OF DAMPING VIBRATION THEREOF"), the entire enclosure of which is incorporated herein by reference.

As for its configuration, a photosensitive drum is provided therein with a metallic cylinder. The metallic cylinder is at least partially surrounded by an elastic member on its outer circumferential surface. The elastic member on the outer circumferential surface of the metallic cylinder is brought into close contact with the vibration damper, which has a coating. The vibration damper is disposed in the cylinder to absorb the vibration of the photosensitive drum.

Another example has been disclosed in Japanese Patent Publication No. 1993-188839 (entitled "IMAGE FORMING APPARATUS"), the entire enclosure of which is incorporated herein by reference.

As for its configuration, a core member is inserted in a photosensitive drum, wherein the core member is constructed by dispersing particles onto an elastic member. The dispersed particles are heavier than the elastic member. The elastic member is heavier than the photosensitive drum and has a predetermined hardness.

However, in the conventional vibration damping configurations disclosed in Japanese Patent Publication Nos. 2001-235971 and 1993-188839, it is very troublesome to insert the vibration damper into the photosensitive drum, while in close contact with the interior of the photosensitive drum. Furthermore, when the photosensitive drum is relatively thin in thickness, there is a possibility of deforming the photosensitive drum.

Furthermore, such a photosensitive drum is expensive to manufacture and is difficult to disassemble after initially being assembled.

FIG. 1 is a perspective view of a conventional configuration where a vibration damper is provided outside of the photosensitive drum.

Referring to FIG. 1, a wheel balance 5 is provided on a rotation shaft 3 of the photosensitive drum 1, wherein the wheel balance 5 is provided outside the photosensitive drum 1, takes a disc shape and has a diameter lager than that of the photosensitive drum 1.

In this manner, when the wheel balance 1 is provided outside the photosensitive drum 1, a separate additional space is needed for installation of the wheel balance 1. Further, its material cost is quite high.

SUMMARY OF THE INVENTION

Accordingly, the present invention provides a photosensitive drum of an image forming apparatus, in which a vibration damper is structurally improved, thereby enhancing assembly efficiency and saving on material costs.

In order to accomplish the foregoing objectives of the present invention, a photosensitive drum of an image forming apparatus includes a drum main body having a hollow shape, and a vibration damping body spaced from an inner wall of the drum main body, having a hollow shape, formed with a plurality of slits. The vibration damping body expands coming into close contact with the inner wall of the drum main body while the drum main body rotates.

Preferably, each of the slits is formed in a longitudinal direction of the vibration damping body and has opposite ends at a predetermined distance from opposite edges of the vibration damping body. The opposite ends of each of the slits are preferably rounded.

The photosensitive drum further includes means for coupling the vibration damping body in the drum main body on opposite edges of the vibration damping body. Preferably, the coupling means comprises an insertion portion forcibly fitted into an inner wall of the vibration damping body on one side thereof. The coupling means preferably also has a vibration damping cap having an outer diameter which is larger than the outer diameter of the vibration damping body, but smaller than the inner diameter of the drum main body.

Further, the coupling means integrally extends from the opposite edges of the vibration damping body. The coupling means comprises a vibration damping portion having an outer diameter which is larger than the outer diameter of the vibration damping body, but smaller than the inner diameter of the drum main body.

Preferably, the vibration damping cap or the vibration damping portion is formed with a through-hole in the center thereof. The opposite edges of the drum main body are preferably provided with drum main body caps formed with a shaft hole corresponding to the through-hole of the vibration damping cap. Additionally, a shaft is forcibly fitted into the through-hole and the shaft hole to fix the vibration damping body and to rotatably support the drum main body.

The vibration damping body is preferably made of a resilient material such as a vibration-proof rubber.

BRIEF DESCRIPTION OF THE DRAWINGS

The above and other features of the present invention will now be described in reference to certain exemplary embodiments thereof with reference to the attached drawings in which.

Throughout the figures, it should be understood that like reference numbers refer to like features and structures.

DETAILED DESCRIPTION OF EXEMPLARY EMBODIMENTS

The present invention will now be described more fully with reference to the accompanying drawings, in which exemplary embodiments of the invention are shown. This invention may, however, be embodied in different forms and should not be limited to the embodiments set forth herein. Rather, these embodiments are provided so that this disclosure will be thorough and complete, and will fully convey the scope of the invention to those of ordinary skill in the art.

Figure 2:
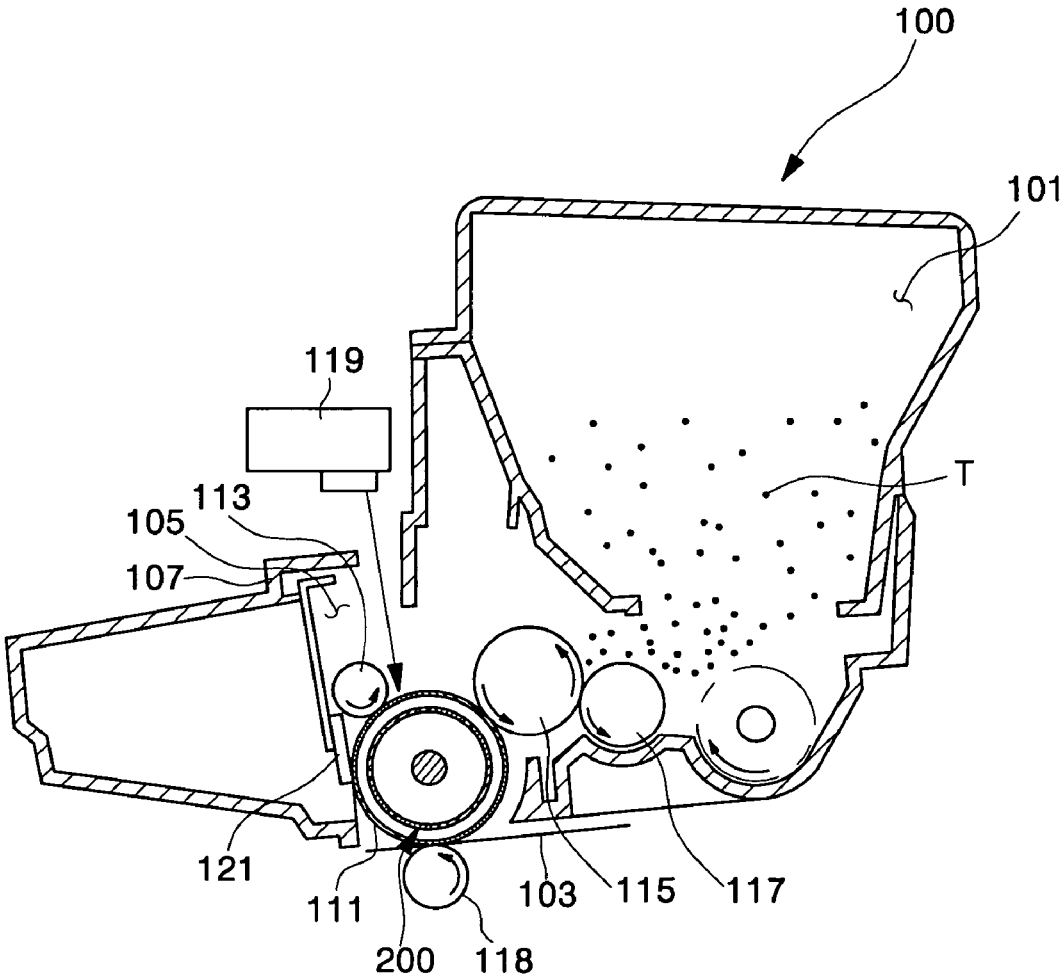
FIG. 2 is a schematic cross-sectional view of an image forming apparatus having a photosensitive drum according to an embodiment of the present invention.

Referring to FIG. 2, an image forming apparatus 100 includes a toner chamber 101 filled with a large quantity of toner T, and a cartridge 107 provided with a developing chamber 105 in which the toner T of the toner chamber 101 is transferred to form an image on a fed sheet 103.

In the developing chamber 105, there are provided a photosensitive drum 111, a charging roller 113, a developing roller 115, a feeding roller 117, an exposing unit 119, and a cleaning blade 121.

The photosensitive drum 111 partially protrudes through a bottom surface of the cartridge 107 and rotates at a predetermined speed. The charging roller 113 rotates in engagement with the photosensitive drum 111 and electrically charges the surface of the photosensitive drum 111 with a high voltage. Further, the photosensitive drum 111 engages a transferring roller 118 which rotates thereunder, thereby forming an image on the sheet 103 fed between the photosensitive drum 111 and the transferring roller 118. The exposing unit 119 is placed above the photosensitive drum 111 and exposes the charged photosensitive drum 111 so as to form a predetermined image thereon. The rotating developing roller 115 closely contacts the photosensitive drum 111 so as to supply toner T to the photosensitive drum 111 having the electrostatic latent image formed thereon by the exposing unit 119.

The rotating feeding roller 117 is on one side of the developing roller 115 and supplies the developing roller 115 with the toner T. The cleaning blade 121, fixed on an upper portion of the cartridge 107, contacts the surface of the photosensitive drum 111 so as to clean remaining developer from the surface of the photosensitive drum 111 after the photosensitive drum 111 rotates.

Figure 3:
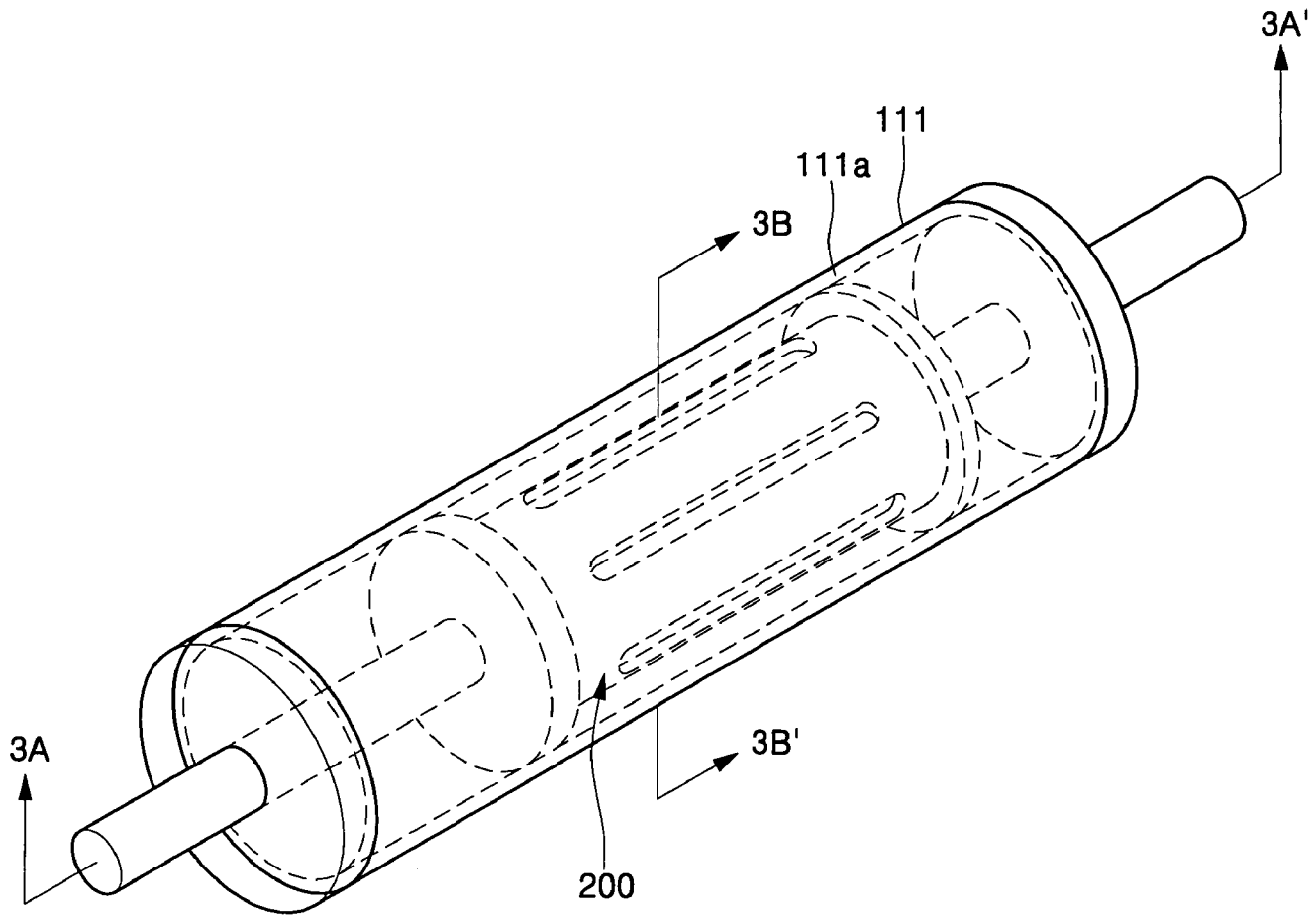
FIG. 3 is a perspective view of a photosensitive drum according to an embodiment of the present invention.

Referring to FIG. 3, a vibration damper 200 is inserted in the photosensitive drum 111 and damps down vibration generated during rotation of the photosensitive drum 111.

Figure 4:
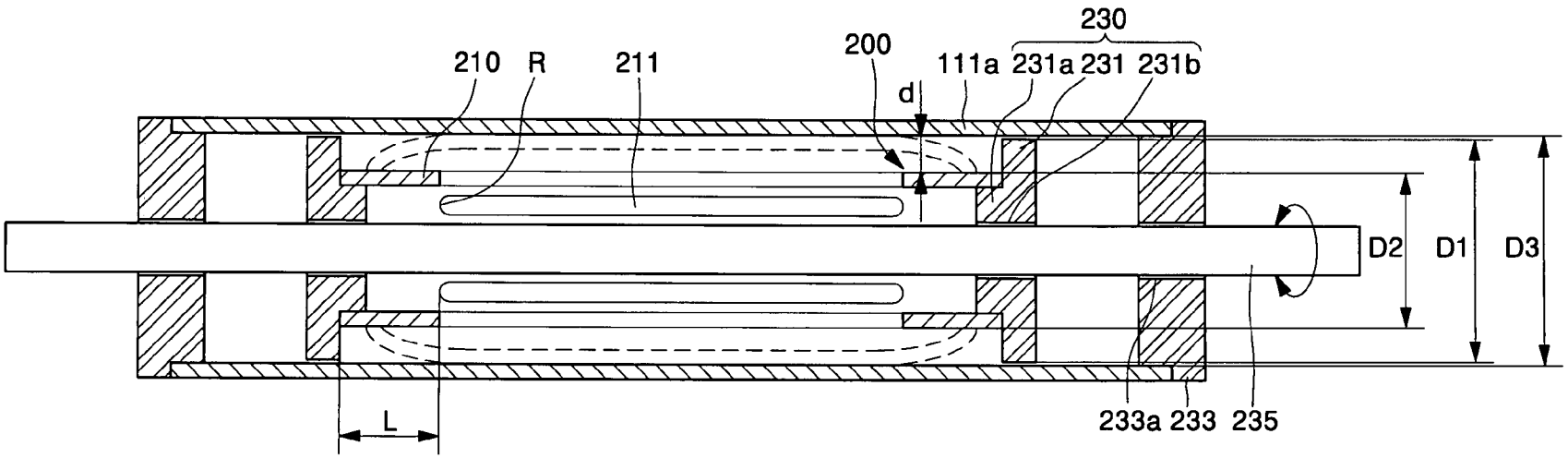
FIG. 4 is a cross-sectional view of the photosensitive drum, taken along line 3A—3A of FIG. 3 according to an embodiment of the present invention.

Referring to FIG. 4, which is a cross sectional view taken along line 3A–3A' of FIG. 3, the vibration damper 200 comprises a vibration damping body 210, which takes a hollow shape and is formed with a plurality of slits 211. Further, the vibration damping body 210 is spaced a predetermined distance d apart from the inner wall of the drum main body 111*a* of the photosensitive drum 111. Hence, when the drum main body 111*a* rotates, the vibration damping body 210 expands bringing it into close contact with the inner wall of the drum main body 111*a*.

Here, the vibration damping body 210 is preferably made of a resilient material such as a vibration-proof rubber for expansion.

Preferably, slits 211 are formed in a longitudinal direction of the vibration damping body 210. The opposite ends of each slit 211 are located at a position separated by predetermined distance L from the opposite edges of the vibration damping body 210, respectively (refer to FIG. 6). Further, each end of each slit 211 has a rounding portion R (refer to FIG. 6), so that the vibration damping body 210 is prevented from being torn due to any slits 211 even though the vibration damping body 210 is expanded.

Figure 5:
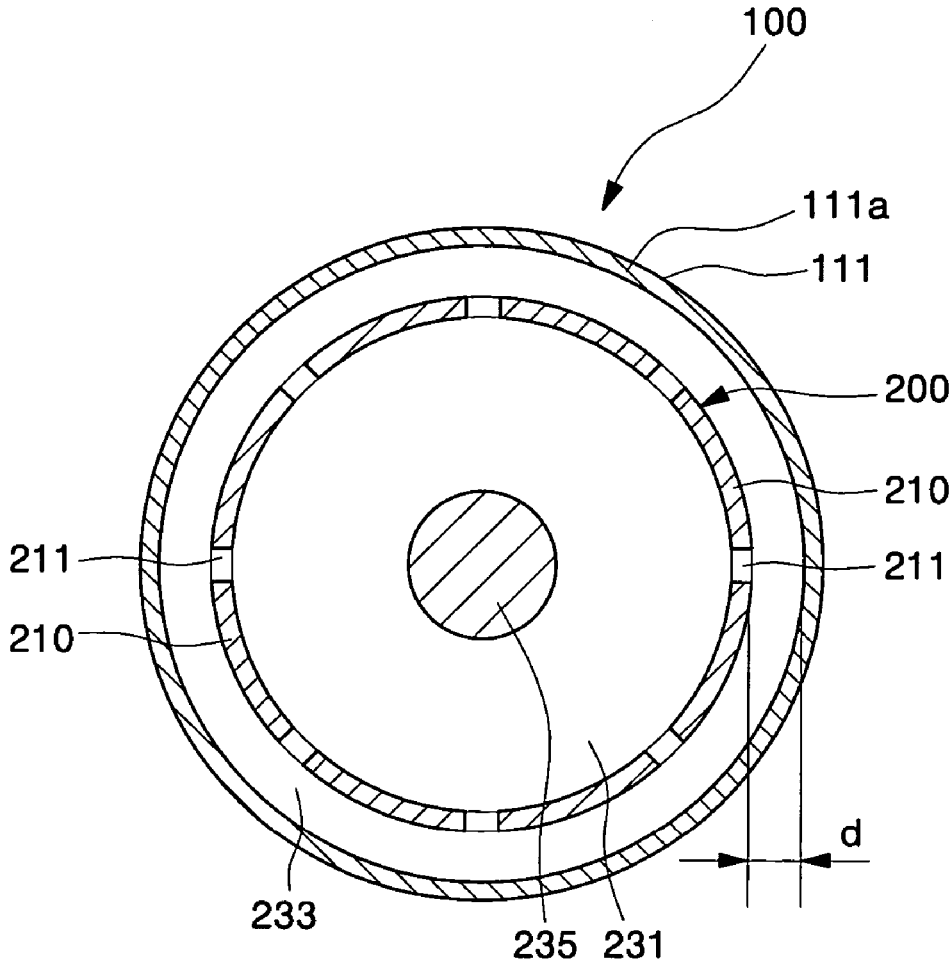
FIG. 5 is a cross-sectional view of the photosensitive drum, taken along line 3B—3B of FIG. 3 according to an embodiment of the present invention.

Referring to FIG. 5, which is a cross sectional view along line 3B–3B' of FIG. 3, the plurality of slits 211 are formed at predetermined intervals along the circumferential direction of the vibration damping body 210. For example, eight slits 211 are shown in FIG. 5.

Hereinafter, a more detailed description will be made regarding the configuration of the vibration damping body 210 within the drum main body 11*a*.

Figure 6:
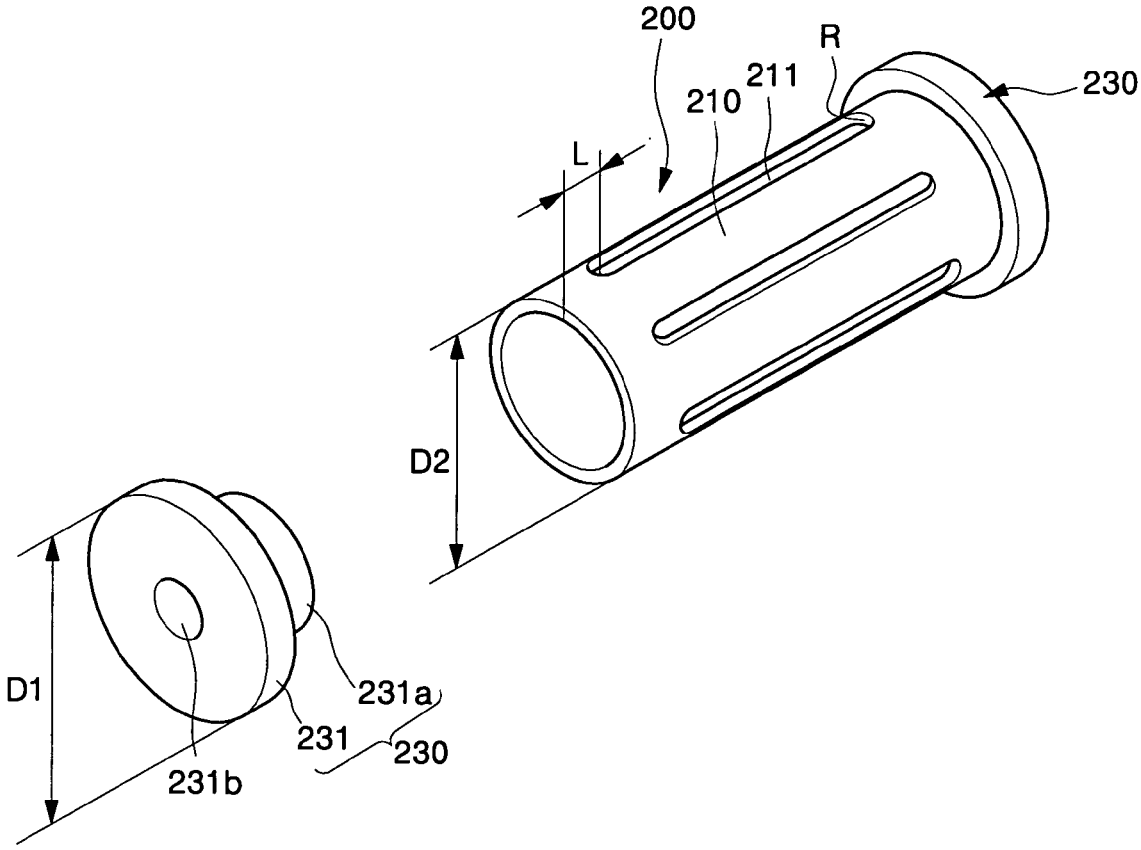
FIG. 6 is a perspective view of a vibration damper according to an embodiment of the present invention.

Referring to FIGS. 4 and 6, a pair of couplers 230 is additionally provided on the both opposite edges of the vibration damping body 210 and allow the vibration damping body 210 to be fixed to and spaced from the inner wall of the drum main body 111*a* at the distance d.

Each coupler 230 comprises an insertion portion 231*a* protruding into and forcibly fitting in the inner wall of the vibration damping body 210 on one side thereof. The coupler 230 further comprises a vibration damping cap 231 having an outer diameter D1, which is larger than an outer diameter D2 of the vibration damping body 210, but smaller than an inner diameter D3 of the drum main body 111*a*. Here, because the outer diameter D1 of the vibration damping cap 231 is smaller than the inner diameter D3 of the drum main body 111*a*, the vibration damping body 230 is easily assembled and disassembled from the drum main body 111*a* and does not cause the drum main body 111*a* to be deformed.

Further, the vibration damping cap 231 is formed with a through-hole 231*b* in the center thereof. Additionally, a pair of drum main body caps 233 are provided in the opposite edges of the drum main body 11*a*, and each formed with a shaft hole 233*a* corresponding to the through-hole 231*b* of the vibration damping cap 231.

Both the through-hole 231*b* and the shaft hole 233*a* are forcibly fitted onto shaft 235, so that the vibration damping body 210 is fixed in and rotatably supports the drum main body 111*a*.

Figure 7:
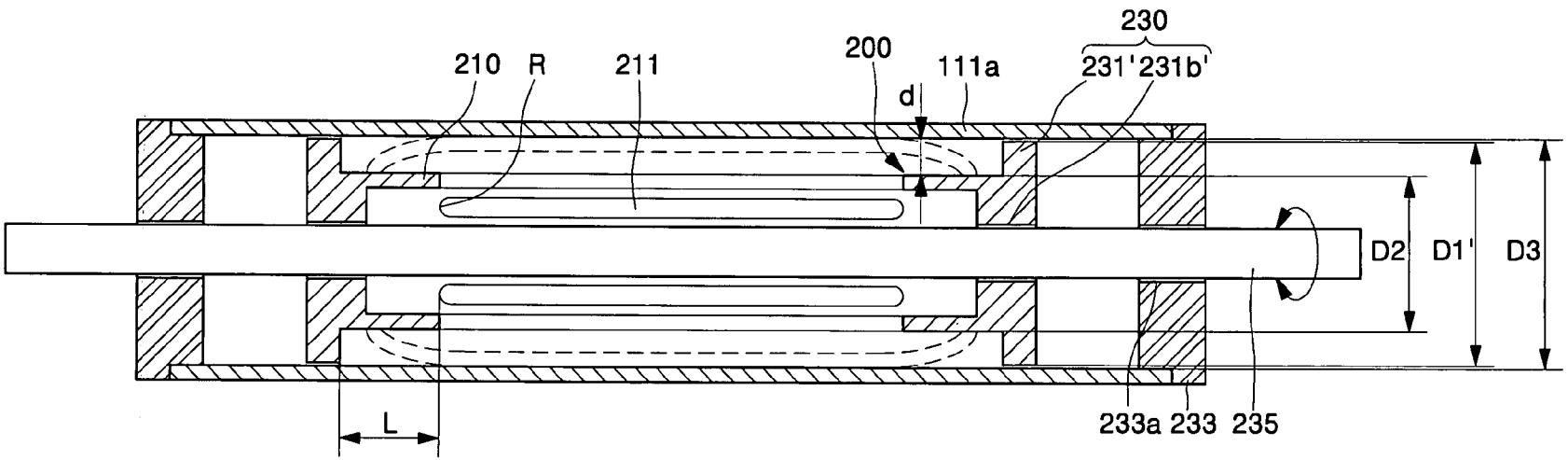
FIG. 7 is a perspective view of a vibration damper according to another embodiment of the present invention.

FIG. 7 is a perspective view illustrating another exemplary embodiment of the coupler 230.

As for a difference between the couplers of FIGS. 4 and 6 and those of FIG. 7, vibration damping portions 231' of FIG. 7 integrally extends from the opposite edges of the vibration damping body 210, having the same shape as the vibration damping cap 231.

Hereinbelow, elements similar to those of FIGS. 4 and 6 will be given like numbers and therefore, their detailed descriptions will be omitted for sake of clarity.

The vibration damping portion 231' has an outer diameter D1 larger than the outer diameter D2 of the vibration damping body 210, but smaller than the inner diameter D3 of the drum main body 111*a*. Therefore, the vibration damping body 210 is fixed to and spaced from the inner wall of the drum main body 111*a* by a distance d.

Like the vibration damping cap 231, the vibration damping portion 231' is formed with a through-hole 231*b*' in the center thereof corresponding to the shaft hole 233*a* of the drum main body cap 233. The shaft 235 is fitted in both the through-hole 231*b*' and the shaft hole 233*a*.

Figure 1:
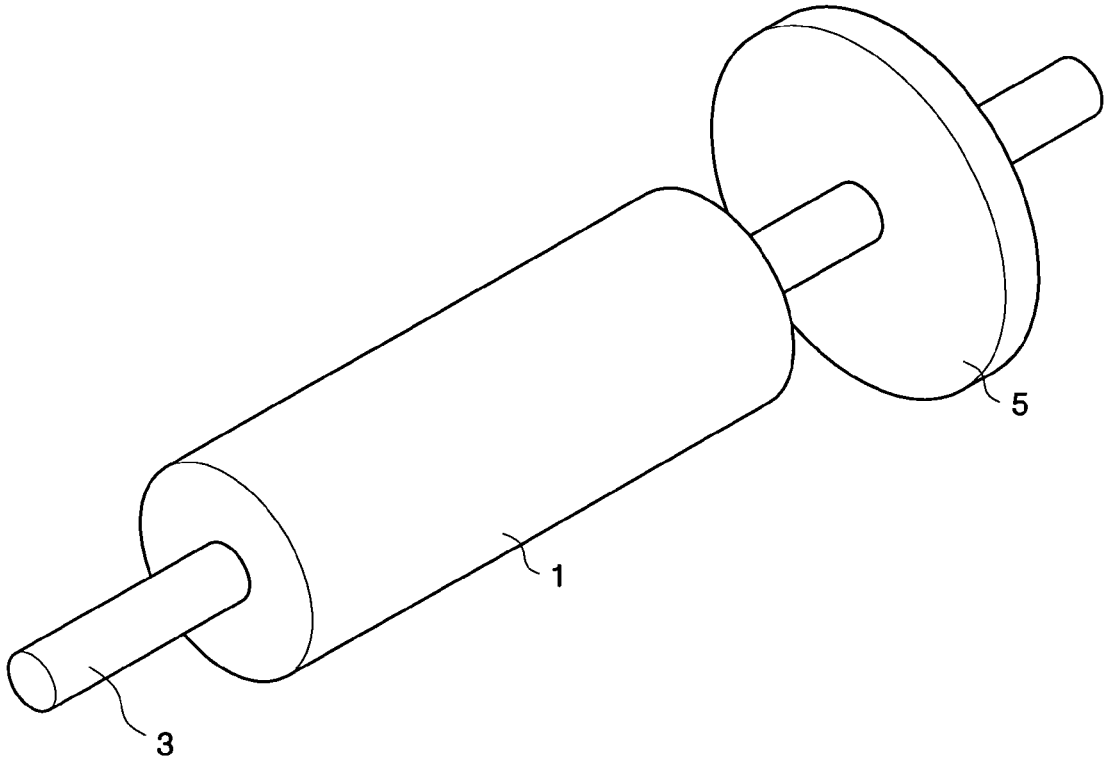
FIG. 1 is a perspective view of a vibration damper in a conventional photosensitive drum.

Now, the operation of the vibration damper 200 configured as set forth above will be described with reference to FIG. 1.

In the image forming apparatus 100, the toner T filled in the toner chamber 101 is first supplied to the feeding roller 117. At this time, the feeding roller 117 rotates in the same direction as the developing roller 115, thereby applying the toner T to the developing roller 115 and frictionally charging the toner T with electricity.

The photosensitive drum 111 is charged with a high voltage by the charging roller 113, and then formed with the electrostatic latent image by the exposing unit 119.

Then, the toner T supplied to the developing roller 115 attaches to the electrostatic latent image formed on the photosensitive drum 111. A sheet 103 is fed between the photosensitive drum 111 and the transferring roller 118, so that an image is formed on the sheet 103.

Thereafter, while the photosensitive drum 111 continuously rotates, the cleaning blade 121 cleans the toner T remaining on the surface of the photosensitive drum 111, thereby allowing the photosensitive drum 111 to form a new electrostatic latent image thereon.

While the image is formed through the foregoing operation, the photosensitive drum 111 is resonated by vibrations from the gears (not shown) of the motor (not shown) when it rotates or vibrated by friction when it contacts the cleaning blade 121.

Such vibration is suppressed by the vibration damper 200 provided in the photosensitive drum 111.

As shown in FIG. 4, while the photosensitive drum 111 rotates at a high speed, the vibration damping body 210 provided in the photosensitive drum 111 expands due to centrifugal force or torque, which brings it into close contact with the inner wall of the drum main body 111*a* of the photosensitive drum 111. This dampens the vibration of the photosensitive drum 111. Here, the faster the photosensitive drum 111 rotates, the closer the vibration damping body 210 contacts the inner wall of the drum main body 111.

Further, the vibration damping body 210 is preferably made of a resilient material such as a vibration-proof rubber, which expands easily thereby further enhancing the vibration damping effect.

Here, when the vibration damping body 210 expands and closely contacts the inner wall of the drum main body 111*a*, there is a possibility that the opposite ends of the slits 211 may be torn. However, the opposite ends of the slits 211 are rounded to have the rounding portion R and formed at a predetermined distance L from the opposite edges of the vibration damping body 210, thereby resist tearing.

As described above, the present invention provides a photosensitive drum of an image forming apparatus, in which a vibration damper expands and closely contacts the inner wall of the photosensitive drum when the photosensitive drum rotates. This maximizes the vibration-damping effect and thus enhances image quality and reduces noise.

Further, the present invention provides a photosensitive drum of an image forming apparatus, in which a vibration damper is easily assembled and disassembled from the photosensitive drum, thereby improving assembly efficiency and preventing the photosensitive drum from deforming when the vibration damper is inserted in the photosensitive drum.

While the present invention has been described with reference to a particular embodiment, it is understood that the disclosure has been made for purpose of illustrating the invention by way of examples and is not intended to limit the scope of the invention. One skilled in the art can amend and change the present invention without departing from the scope and spirit of the invention.

What is claimed is:

1. A photosensitive drum of an image forming apparatus, comprising:

a drum main body having a hollow shape and an internal diameter; and a vibration damping body insertable into the drum main body, the vibration damping body having an outer diameter which is smaller than the internal diameter of the drum main body while the drum main body is not rotating, and, the vibration damping body having a plurality of slits, and expanding and contacting the inner wall of the drum main body while the drum main body rotates.

2. The photosensitive drum as claimed in claim 1, wherein the slits are each formed in a longitudinal direction of the vibration damping body with opposite ends at a predetermined distance from opposite edges of the vibration damping body.

3. The photosensitive drum as claimed in claim 2, wherein the opposite ends of each of the slits are rounded.

4. The photosensitive drum as claimed in claim 1, further comprising means for coupling the vibration damping body into the drum main body on opposite edges of the vibration damping body.

5. The photosensitive drum as claimed in claim 4, wherein the coupling means comprises an insertion portion forcibly fitted in an inner wall of the vibration damping body on one side thereof, and a vibration damping cap having an outer diameter which is larger than an outer diameter of the vibration damping body, and smaller than an inner diameter of the drum main body.

6. The photosensitive drum as claimed in claim 4, wherein the coupling means integrally extend from the opposite edges of the vibration damping body, and comprises a vibration damping portion having an outer diameter which is larger than the outer diameter of the vibration damping body, and smaller than an inner diameter of the drum main body.

7. The photosensitive drum as claimed in claim 5, wherein the vibration damping cap is formed with a through-hole in the center thereof, the opposite edges of the drum main body are additionally provided with drum main body caps formed with a shaft hole corresponding to the through-hole of the vibration damping cap, and a shaft is forcibly fitted into the through-hole and the shaft hole to fix the vibration damping body and to rotatably support the drum main body.

8. The photosensitive drum as claimed in claim 6, wherein the vibration damping portion is formed with a through-hole in the center thereof, the opposite edges of the drum main body are additionally provided with drum main body caps formed with a shaft hole corresponding to the through-hole of a vibration damping cap, and a shaft is forcibly fitted in the through-hole and the shaft hole fixes the vibration damping body and rotatably supports the drum main body.

9. The photosensitive drum as claimed in claim 1, wherein the vibration damping body is made of a resilient material.

10. The photosensitive drum as claimed in claim 9, wherein the resilient material includes a vibration-proof rubber.

11. A method of dampening vibration in an image forming apparatus comprising the steps of:

inserting a vibration damping body into the hollow opening of a cylindrical photosensitive drum so that the vibration damping body is spaced apart from the inner wall of the photosensitive drum;

securing the vibration damping body into the cylindrical photosensitive drum; and expanding the vibration damping body to contact the inner wall of the photosensitive drum as the photosensitive drum rotates.

12. The method of claim 11, wherein the vibration damping body portion is made of a resilient material.

13. The method of claim 11, wherein the vibration damping body comprises a plurality of longitudinal slits located at predetermined intervals around the circumference of the vibration damping body.

14. The method of claim 13, wherein the plurality of longitudinal slits have rounded ends.

15. A photosensitive drum of an image forming apparatus, comprising:

a cylindrical drum body having an inner wall, the cylindrical drum body having an internal diameter;

a vibration damping body disposed inside the drum body, the vibration damping body having an outer diameter which is smaller than the internal diameter of the drum body; and a pair of couplers for coupling ends of the vibration damping body to the drum body, wherein the vibration damping body expands and contacts the inner wall of the drum body while the drum body rotates.

16. The photosensitive drum as claimed in claim 15, wherein the vibration dampening body has a plurality of slits formed along a longitudinal direction of the vibration damping body.

17. The photosensitive drum as claimed in claim 16, wherein the ends of each of the plurality of slits are rounded.

18. The photosensitive drum as claimed in claim 15, wherein each coupler comprises an insertion portion force fit into an inner wall of the vibration damping body.

19. The photosensitive drum as claimed in claim 15, wherein each coupler further comprises a vibration damping cap coupled to the insertion portion, the vibration damping cap having an outer diameter which is larger than an outer diameter of the vibration damping body and which is smaller than the internal diameter of the drum body.

20. The photosensitive drum as claimed in claim 19, further comprising a pair of drum body caps provided at opposite ends of the drum body.

* * * * *